US011828067B2

(12) United States Patent
Lenney

(10) Patent No.: US 11,828,067 B2
(45) Date of Patent: Nov. 28, 2023

(54) DRIP EDGE WITH GUTTER GUARD SUPPORT

(71) Applicant: GutterGlove, Inc., Roseville, CA (US)

(72) Inventor: Robert C. Lenney, Lincoln, CA (US)

(73) Assignee: GUTTERGLOVE, INC., Franklin, TN (US)

( * ) Notice: Subject to any disclaimer, the term of this patent is extended or adjusted under 35 U.S.C. 154(b) by 140 days.

(21) Appl. No.: 17/355,096

(22) Filed: Jun. 22, 2021

(65) Prior Publication Data

US 2022/0403661 A1 Dec. 22, 2022

(51) Int. Cl.
*E04D 13/076* (2006.01)
*E04D 13/068* (2006.01)

(52) U.S. Cl.
CPC ..... *E04D 13/076* (2013.01); *E04D 13/0685* (2013.01)

(58) Field of Classification Search
CPC ... E04D 13/076; E04D 13/0685; E04D 13/18; E04D 13/0459; E04D 2013/0468; E04D 13/158
See application file for complete search history.

(56) References Cited

U.S. PATENT DOCUMENTS 3,137,970 A * 6/1964 Tiernan ..... E04D 13/15 52/630
3,242,622 A * 3/1966 Snead ..... E04D 13/15 52/364
3,243,926 A * 4/1966 Keyt ..... E04D 13/15 52/287.1
5,170,597 A * 12/1992 Stearns ..... E04D 13/158 52/11
5,414,965 A * 5/1995 Kelley ..... E04D 13/064 52/60

(Continued)

FOREIGN PATENT DOCUMENTS

CA 2267409 A1 * 9/1999 ..... E04D 13/0459

OTHER PUBLICATIONS

Lowe's Building Supplies Siding & Stone Veneer Metal Siding Trim; Metal Sales 2-in x 126-in Galvanized J-channel Metal Siding Trim; https://www.lowes.com/pd/Metal-Sales-2-in-x-126-in-Galvanized-J-channel-Metal-Siding-Trim/1000421491; Item #911627Model #4227441LW.

(Continued)

*Primary Examiner* — Babajide A Demuren
(74) *Attorney, Agent, or Firm* — Jonathan Kidney; Glen Gross; Intelink Law Group, P.C.

(57) ABSTRACT

A drip edge with gutter guard support device is formed from a longitudinal sheet of waterproof material. An angled upper first member integrally joined to a vertical lower second member form an angled structure. The first member is configured for placement on a roof edge and under a roof shingle and the second member is a configured for placement to a fascia, the lower portion of the second member being configured for placement over a gutter's back end. Vertically stacked ledges extend outwardly from the second member into an opening of the gutter. Separations between adjacent ledges form varying height receiving channels for placement of a roof-side end of a gutter guard. The device is a single piece drip edge and gutter guard fascia-side attachment device.

23 Claims, 13 Drawing Sheets

(56) References Cited

U.S. PATENT DOCUMENTS

| | | | | |
|---|---|---|---|---|
| 5,515,653 | A * | 5/1996 | Smart | E04D 13/15 52/60 |
| 5,586,414 | A * | 12/1996 | Tawzer | E04D 5/14 52/96 |
| 8,739,470 | B1 * | 6/2014 | Wayne | E04D 13/15 52/96 |
| 10,132,085 | B2 * | 11/2018 | Bredeweg | E04D 13/0459 |
| 10,495,290 | B1 * | 12/2019 | Genenbacher | F21V 33/006 |
| 10,844,604 | B2 * | 11/2020 | Folkersen | E04D 13/158 |
| 11,060,291 | B2 * | 7/2021 | Gramling | E04D 13/0725 |
| 11,266,142 | B1 * | 3/2022 | Bishop | E04D 13/004 |
| 11,692,353 | B2 * | 7/2023 | Folkersen | E04D 13/1478 52/58 |
| 2006/0037252 | A1 * | 2/2006 | Gosse | E04D 13/076 52/11 |
| 2007/0074466 | A1 * | 4/2007 | Rasmussen | E04D 13/15 52/97 |
| 2011/0049118 | A1 * | 3/2011 | Nark | E04D 13/103 248/237 |
| 2012/0233933 | A1 * | 9/2012 | Rasmussen | B21D 5/08 52/58 |
| 2012/0279168 | A1 * | 11/2012 | Rasmussen | E04D 13/158 52/745.19 |
| 2012/0304578 | A1 * | 12/2012 | Williams | E04D 13/0459 52/520 |
| 2014/0326837 | A1 * | 11/2014 | Rumsey | H05B 3/06 248/65 |
| 2016/0102459 | A1 * | 4/2016 | Breyer | E04D 13/0767 52/12 |

OTHER PUBLICATIONS

The Home Depot Building Materials Siding Siding Trim; J-Channel Galvanized Steel; https://www.homedepot.com/p/J-Channel-Galvanized-Steel-4749650000/100039514#overlay; Internet #100039514 Model #4749650000 Store SKU #786949.

Lynch Aluminum MFG Co .; Klynch Channel; https://www.lynchaluminum.com/product/klynch-channel/; SKU: 175.

Lynch Channel; SKU: 175; Categories: Gutter Guard, Tags: 7', channel, Klynch, Gutter guard, 5", 6", 150'; Manufactured in the USA by Lynch Aluminum MFG Co.; Dec. 22, 2021. (https://www.lynchaluminum.com/product/klynch-channel/).

* cited by examiner

DRIP EDGE WITH GUTTER GUARD SUPPORT

FIELD

This invention relates to gutter guards and protecting gutters from having debris entering a gutter while still allowing water to flow into the gutter.

BACKGROUND

Rain gutters are generally attached to buildings or structures that have a pitched roof. The gutters are designed to collect and divert rainwater that runs off the roof. The gutter channels the rainwater (water) to downspouts that are connected to the bottom of the gutter at various locations. The downspouts divert the water to the ground surface or underground drainage system and away from the building.

Gutters have a large opening, which runs parallel to the roofline, to collect water. A drawback of this large opening is that debris, such as leaves, pine needles and the like can readily enter the opening and eventually clog the gutter. Once the rain gutter fills up with debris, rainwater can spill over the top and on to the ground, which compromises the effectiveness of the gutter, and can cause water damage to the home and erode surrounding landscapes.

A primary solution to obstruct debris from entering a gutter opening is the use of debris preclusion devices, most commonly known in the public as gutter guards. Gutter guard types abound in the marketplace and the industry is constantly innovating to find more efficient configurations that not only keep debris, such as leaves and pine needles out of the gutter, but also keep out even smaller particles like tiny roof sand grit.

In the roofing industry, a flashing type material commonly known as a "drip edge" is installed at the lowest point of the roof (where most roof structures would have a fascia board attached to the for horizontal edge of the roof) to prohibit water or melting snow ingress into the house. The drip edge is generally made from thin sheeted steel or aluminum and shaped like an "L" and travels up the sloped portion of the roof several inches and down the side of the fascia an inch or more. If the drip edge is compromised or not installed, over time water can wick back up the sloped roof or down the fascia and seep inside the home and potentially cause damage to the home.

If a gutter is attached to the fascia, the drip edge is generally on the inside of the back of the gutter. If the gutter is installed after the drip edge is installed, the back of the gutter would be inserted between the fascia and the drip edge. This way, when water comes down the roof and over the edge of the roof, any water wicked back under the shingles would travel down on top of the drip edge and drop into the gutter. The gutter would then channel the water away from the home.

In some municipalities, the shingles atop the fascia are required by local building codes to be permanently fastened to the fascia or roofing sheeting material. This is because tornadoes, super high winds, hurricanes or other fierce storms can rip unsecured edges of the roofing shingles up and off the roof. However, under these codes a gutter debris preclusion device, such as a gutter guard, cannot be installed because the back of the gutter guard cannot be inserted wider the fastened shingles.

Accordingly, there is a need in the industry for a roof or fascia attachment system and method that allows for drip edge and gutter guard attachment for high wind code compatibility. Various such system(s) and method(s) are elucidated in the following description and figures.

SUMMARY

The following presents a simplified summary in order to provide a basic understanding of some aspects of the claimed subject matter. This summary is not an extensive overview, and is not intended to identify key/critical elements or to delineate the scope of the claimed subject matter. Its purpose is to present some concepts in a simplified form as a prelude to the more detailed description that is presented later.

In one aspect of the disclosed embodiments, a drip edge with gutter guard support device is provided, comprising: a longitudinal sheet of waterproof material, having a side profile comprising: an angled upper first member; a vertical lower second member, integrally joined to a gutter-side end of the first member to form an angled structure, wherein the first member is configured to be disposed over a roof edge and under a roof shingle and the second member is configured to be secured to a fascia, a lower portion of the second member being configured to be placed over a back end of a prospective gutter; and a plurality of vertically stacked ledges integral to and extending outwardly from a face of the second member into an opening of the prospective gutter, separations between adjacent ledges forming varying height receiving channels for placement of a roof-side end of the prospective gutter guard when the prospective gutter guard is disposed on the prospective gutter, wherein the device is a single piece drip edge and gutter guard fascia-side attachment device.

In another aspect of the disclosed embodiments, the above device is provided, wherein the first member is at least 0.5 inches long, the second member is at least 0.5 inches long and the ledges are at least 0.25 inches long, and the separations between adjacent ledges is at least 0.25 inches; and/or further comprising a water ramp, the water ramp being disposed on a bottom terminal end of the second member; and/or wherein the water ramp is multiply-angled; and/or wherein at least one of the water ramp and second member contains an arc, the arc acting to press against a top end of a prospective gutter under the water ramp; and or wherein at least two of the ledges are parallel to each other and at least one of perpendicular, inclined or declined from the second member; and/or wherein a first ledge is of a different width than a second ledge; and/or wherein at a thickness of at least one of the first member and second member is non-uniform; and/or wherein alternating ledges are of equal width; and/or wherein the separations between adjacent ledges are of unequal distances; and/or wherein the separations between adjacent ledges are at least 0.5 inches; and/or wherein an angle of the angled structure is at least 90 degrees; and/or wherein the second member is longer than the first member; and/or wherein a topmost ledge of the plurality of ledges is proximal to an intersection of the first member to the second member; and/or wherein the device is constructed from one of a sheeted, extruded, coiled aluminum, steel, metal or plastic.

In another aspect of the disclosed embodiments, a drip edge with gutter guard support device is provided, comprising: a longitudinal sheet of waterproof material, having a side profile comprising: a vertical member configured to be placed inside and over a back end of a prospective gutter; and a plurality of vertically stacked longitudinal ledges extending outwardly from a face of the vertical member into an opening of the prospective gutter, separations between adjacent ledges forming varying height receiving channels for placement of a roof-side end of the prospective gutter guard when the prospective gutter guard is disposed on the prospective gutter.

In yet another aspect of the disclosed embodiments, the above device is provided, wherein a topmost ledge is of a greater width than a bottommost ledge; and/or wherein the device is constructed from one of a sheeted, extruded, coiled aluminum, steel, metal or plastic.

In yet another aspect of the disclosed embodiments, a drip edge with glitter guard support device is provided, comprising: a longitudinal sheet of waterproof material having an L-shaped side profile comprising: a vertical member configured to be placed inside and over a back end of a prospective gutter; and a horizontal gutter guard attachment member integral to and extending outwardly from a top of the vertical member into an opening of the prospective gutter, a water ramp integral to a bottom end of the vertical member, extending into the prospective gutter at an acute angle from a plane of the vertical member; and a longitudinal screw trough disposed in the vertical member above the water ramp.

In yet another aspect of the disclosed embodiments, the above device is provided, wherein the device is constructed from one of a sheeted, extruded, coiled aluminum, steel, metal or plastic.

BRIEF DESCRIPTION OF THE DRAWINGS

FIG. 12F is a side profile of another exemplary DEGGS with an arc placed within the second member and various profile, shape ledges.

DETAILED DESCRIPTION

In various embodiments, a drip edge device is devised that has a built-in bracket or sleeve for receiving a roof-side end of a gutter guard. The configuration is referred herein as a "Drip Edge with Gutter Guard Support" (DEGGS). The DEGGS solves the problem of having to install a drip edge and a separate gutter support bracket by combining the elements into one design, one product instead of two. Roofing contractors could install the exemplary DEGGS as a traditional functioning drip edge then later install a gutter guard into the DEGGS.

Figure 1:
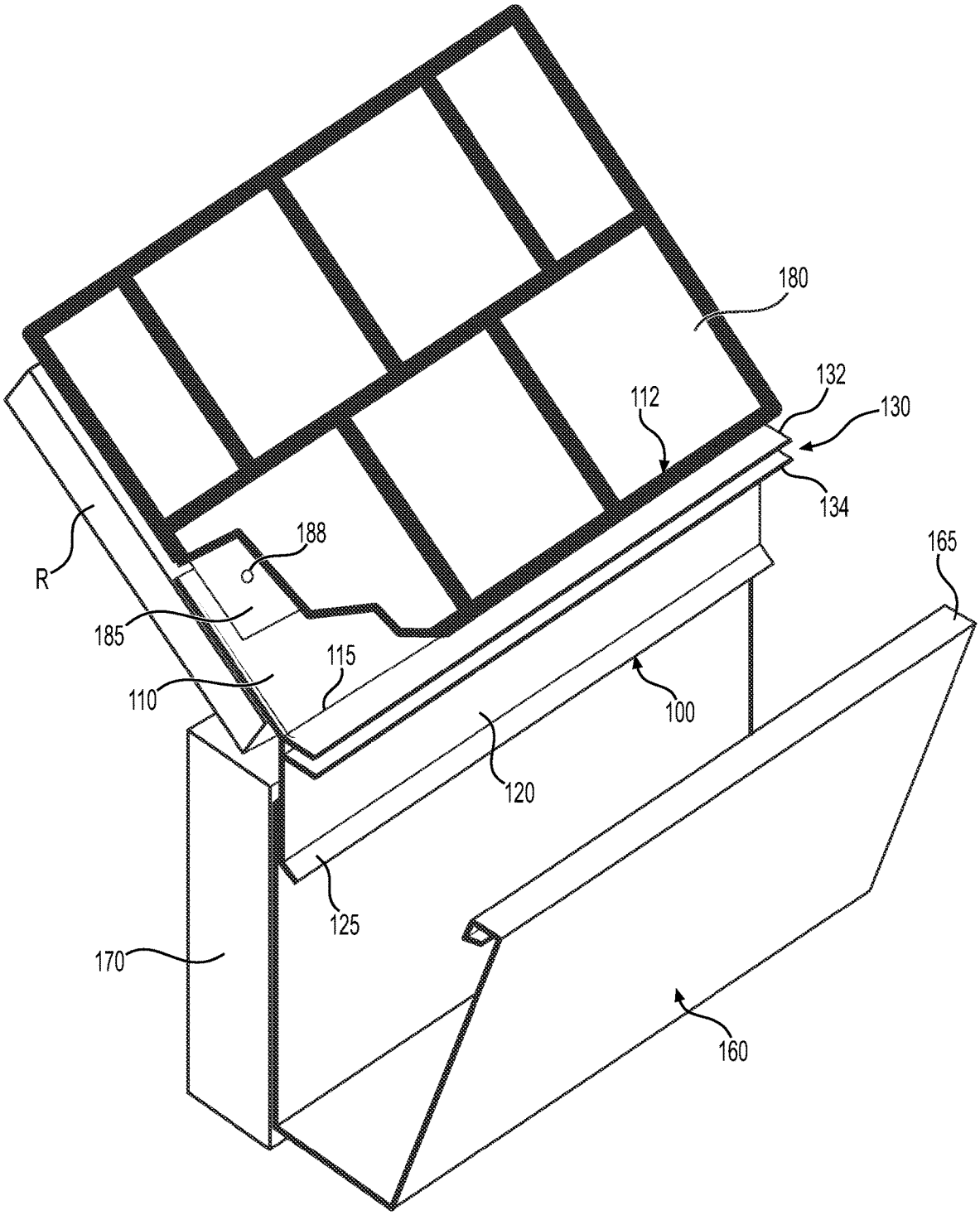
FIG. 1 is an illustration of an exemplary drip edge with sitter guard support (DEGGS) is installed along edge of a roof.

It should be appreciated that a DEGGS can be widely used in any type of gutter-to-roof scenario, not just on roofs where the shingles must be fastened tightly along the front horizontal edge of a roofline required by building codes in certain regions of the US or elsewhere, FIG. 1 is an illustration of an exemplary DEGGS 100 is installed along edge 112 of a roof R. Roof R is shown here covered with shingles 180 laid over an intermediary roofing cover material 185. Nails or fasteners 188 secure the roofing cover material 185 and/or the shingles 180 to the roof R. Under the edge 112 of roof R, is a side barrier 170 typically called, in the industry, the fascia. Generally, the fascia 170 is where the gutter 160 is attached to.

The DEGGS 100 can be shaped as a single angled piece having an angled first member 110 and vertical second member 120, sharing a longitudinal common edge 115. First and second members 110 and 120 may be rectangular in shape and formed from a unitary material. First member 110 forms a roof-directed leg while second member 120 forms a fascia-directed leg of the DEGGS 100. The angle of the respective members is such to allow the DEGGS 100 to be easily fitted to roof edge 112 and fascia 170. For most applications, the angle will be greater than 90 degrees.

Second member 120 may further have water ramp 125 at its lower terminal end, which operated to draw water to a more central position within the gutter 60. Second member 120 further includes an integral guard support member 130 disposed in the second member 120. Guard support member 130 can be in the form of a plurality of parallel ledges (shown here as two ledges 132, 134 vertically separated from each other) so as to provide a receiving channel for a gutter guard (not shown). One or more ledges of guard support member 130 may run longitudinally an entire length of the DEGGS 100 or may run partially as segments. That is, in some embodiments, the guard support member 130 may only exist for a limited length, understanding that in some implementations, an entire "matching" length of the guard support member 130 may not be necessary to allow for attachment of a gutter guard. Guard support member 130 can be disposed on the upper surface of the second member 120 as shown in this FIG. at the junction of the first member 120 and second member 120 or on a lower portion of the second member 120.

In this embodiment, the gutter 160 is attached to the fascia 170, a top portion of the back of the gutter 160 being, disposed behind second member 120. If rainwater gets under the roofing shingles 180, the DEGGS's first member 110 will divert the water over guard support member 130 down onto second member 120, over optional water ramp 125 and into the gutter 160. DEGGS 100 is generally attached to the roof R by using nails or other types of fasteners (not shown). In most roofing installations, roofing cover material 185 would be placed under the shingles 180 and over the first member 110 of the DEGGS 100. DEGGS's guard support member 130 is where the back end of a gutter guard (not shown) would connect to, whereas the front of the gutter guard would be attached to the front lip 165 of gutter 160.

Figure 2:
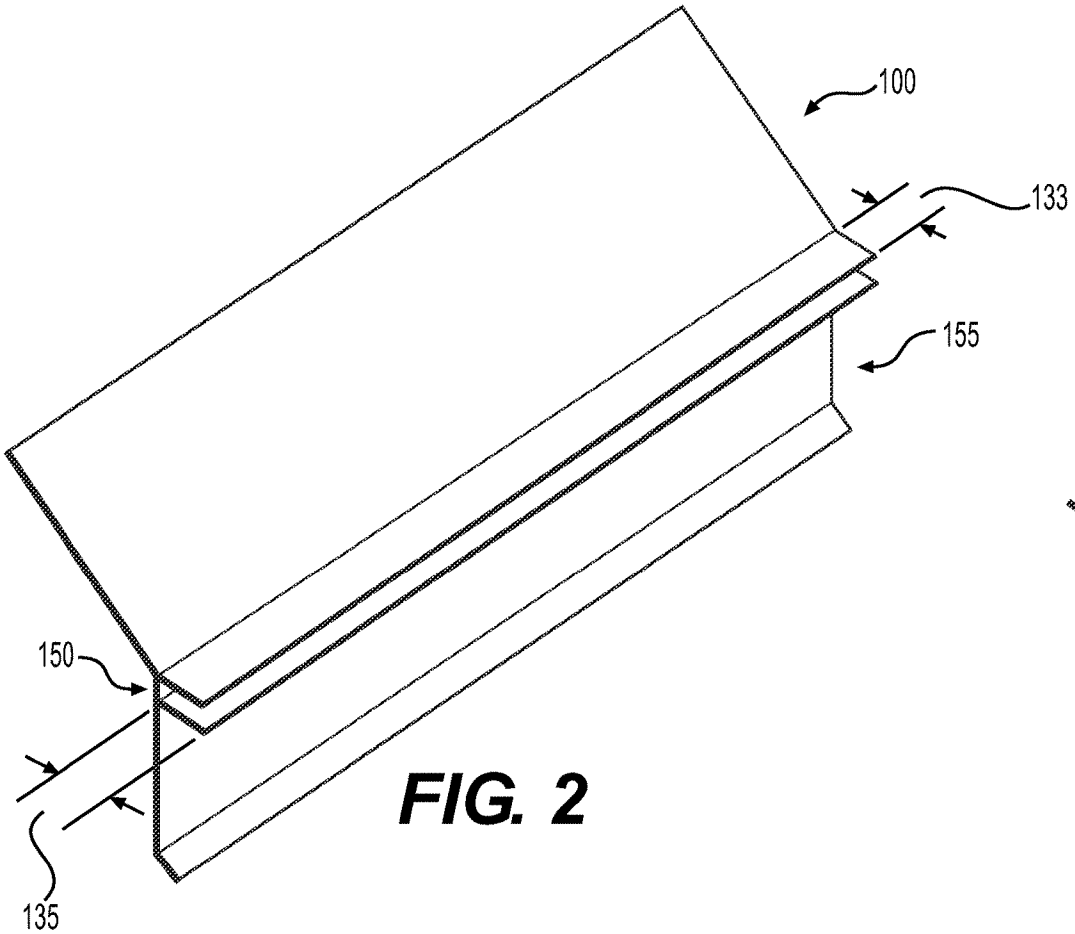
FIG. 2 is a standalone illustration of an exemplary DEGGS.

FIG. 2 is a standalone illustration of the exemplary DEGGS 100 of FIG. 1. Back side 150 faces a building (not shown) and the front side 155 is positioned towards a gutter (not shown). It is expressly understood that the exemplary DEGGSs act as a shield against water penetration and therefore is composed of a material that is water proof, Thus, various materials can be used to make the DEGGS 100 such as sheeted, extruded, coiled aluminum, steel or other similar metals. Plastic, or other stiff materials can also be used, if so desired. A DEGGS 100 can be of varied lengths such as to be less than several inches and spaced apart at the back of the gutter at sufficient distances to support a gutter guard. Typically, however, the DEGGS 100 will be many feet long and may abut next to other sections to span the entire back of a gutter. Typically, the length of exemplary DEGGSs will be about four feet (or to match standard gutter guard lengths). Alternatively, exemplary DEGGSs can be made in longer than four-foot lengths. When installed, the exemplary embodiments can be spaced apart at the back of the gutter so as to provide sufficient support for a gutter guard or alternatively they can be abutted against one another and span along the entire gutter length.

In various prototype embodiments, individual lengths of the first or second members ranged from 0.5 to 4 inches. And individual thicknesses of the first or second members ranged from 0.01 to 0.13 inches. Also, in various prototype embodiments, individual lengths of the ledges ranged from 0.25 to 2 inches, and distances between the respective ledges (e.g., channel width) ranged from 0.25 to 1 inch. It is expressly understood these values are representative of the prototype embodiments and therefore they may vary being greater or smaller for other embodiment types.

In this embodiment, the upper and lower ledge widths 133, 135 are about the same dimension, it is understood the term "width" in the context of the ledges refers to the amount of "extension" from the face of the second member 120. In a prototype embodiment, width 133 was approximately 2 inches and its angle from the second member 120 was approximately 90 degrees (perpendicular). Similarly, width 135 was approximately 2 inches and its angle from the second member 120 approximately 90 degrees (perpendicular). Of course, it is understood that these dimensions and angles may vary, according to design preference.

Figure 3:
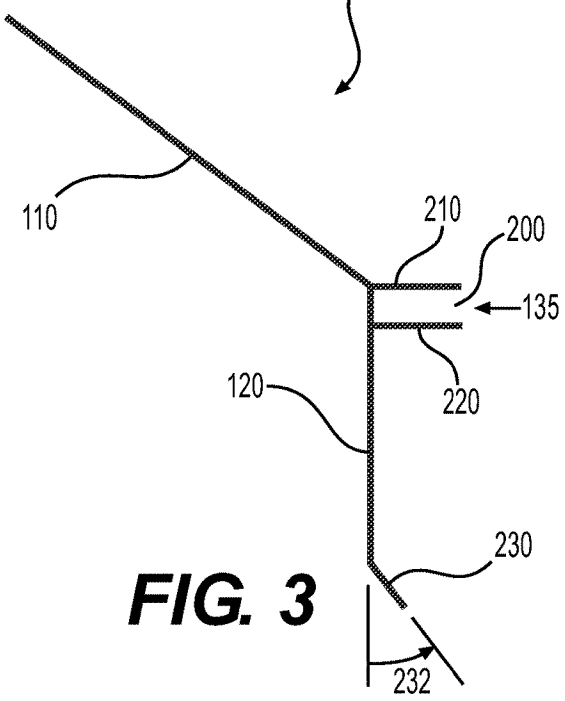
FIG. 3 shows a side profile of an exemplary DEGGS

FIG. 3 shows a side profile of the exemplary DEGGS 100 of FIG. 1. The first member 110 is set at an obtuse angle from the second member 120 to be parallel, to the slope of a roof (not shown). When a sheeted or coiled material is used to make the DEGGS 100, it is generally flexible enough that the first member 110 can be manually bent, or adjusted, at joint 180 to the second member 120 to match the same pitch of the roof. Receiving channel 135 has an opening 200 that the back end of a gutter guard (not shown) can be inserted into. The upper ledge (ceiling) 210 and the lower ledge (floor) 220 of the receiving channel 135 are provided to hold the back end of a gutter guard in place. While upper 210 and lower 220 ledges provide a means for securing the back end of a gutter guard, it is understood that the back end of the gutter guard can instead be secured on top of the upper ledge 210 with screws or other fasteners, if so desired.

Towards the end of the second member 120 is a water ramp 230 that is angled away from the plane of the second member 120. The water ramp angle 232 may be an acute angle or even "curled," if so desired. Moreover, the water ramp 230 may be shorter or longer than depicted, as well as may be composed of multiple angled or curled portions, or even be substituted with an outward "bump" on a non-terminal end of the second member 120. If rainwater travels down the second member 120, it can be deflected by the water ramp 230 away from the back of the gutter and fascia (not shown). If the DEGGS 100 is installed prior to the gutter being installed, this water ramp 230 also provides for easier insertion of the back of a gutter between the DEGGS 100 and the fascia.

Figure 4:
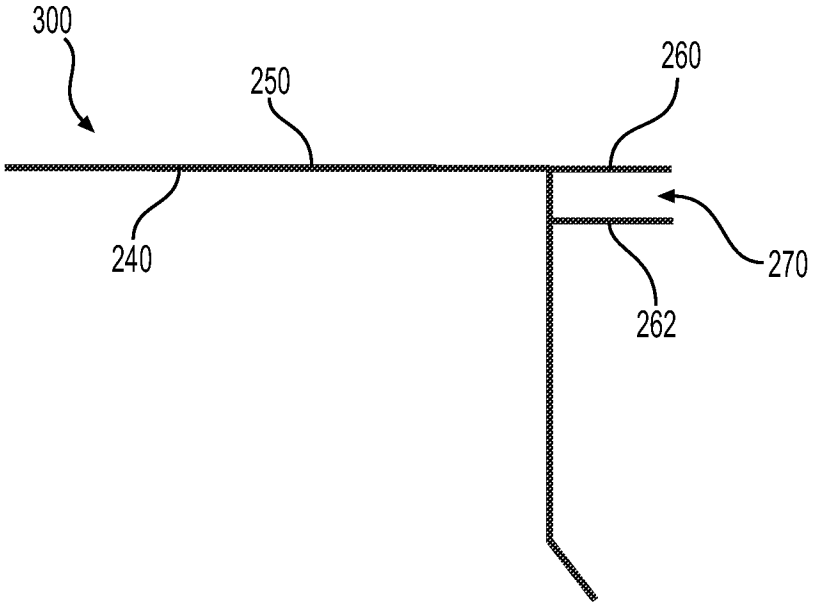
FIG. 4 is a side view illustration of another exemplary DEGGS where the first member is substantially horizontal.

FIG. 4 is a side view illustration of another exemplary DEGGS 300 where first member 240 is substantially horizontal. Thus, surface 250 of the first member 240 is planar, or substantially level with upper ledge 260 of receiving channel 270. Lower ledge 262 is shown parallel to the upper ledge 260 having a similar width. This design would be suitable for installation on a flat or very low-pitched roof. As noted above, depending on original "bend" angle of the DEGGS, the DEGGS may be further flexed or bent to match the roof-to-fascia angle.

Figure 5:
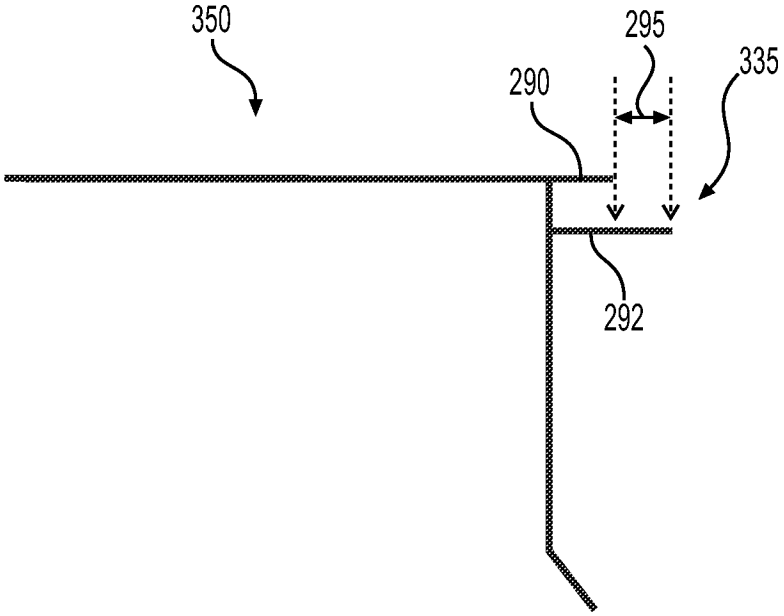
FIG. 5 is a side view illustration of an exemplary DEGGS which is a variation of the DEGGS of FIG. 4.

FIG. 5 is a side view illustration of a DEGGS embodiment 350 which is a variation of the DEGGS of FIG. 4, where the upper ledge 290 of receiving channel 335 is shorter by an arbitrary width 295 than the lower ledge 292. Conversely, not shown, but also possible, the lower ledge 292 may be shorter than the upper ledge 290.

Figure 6:
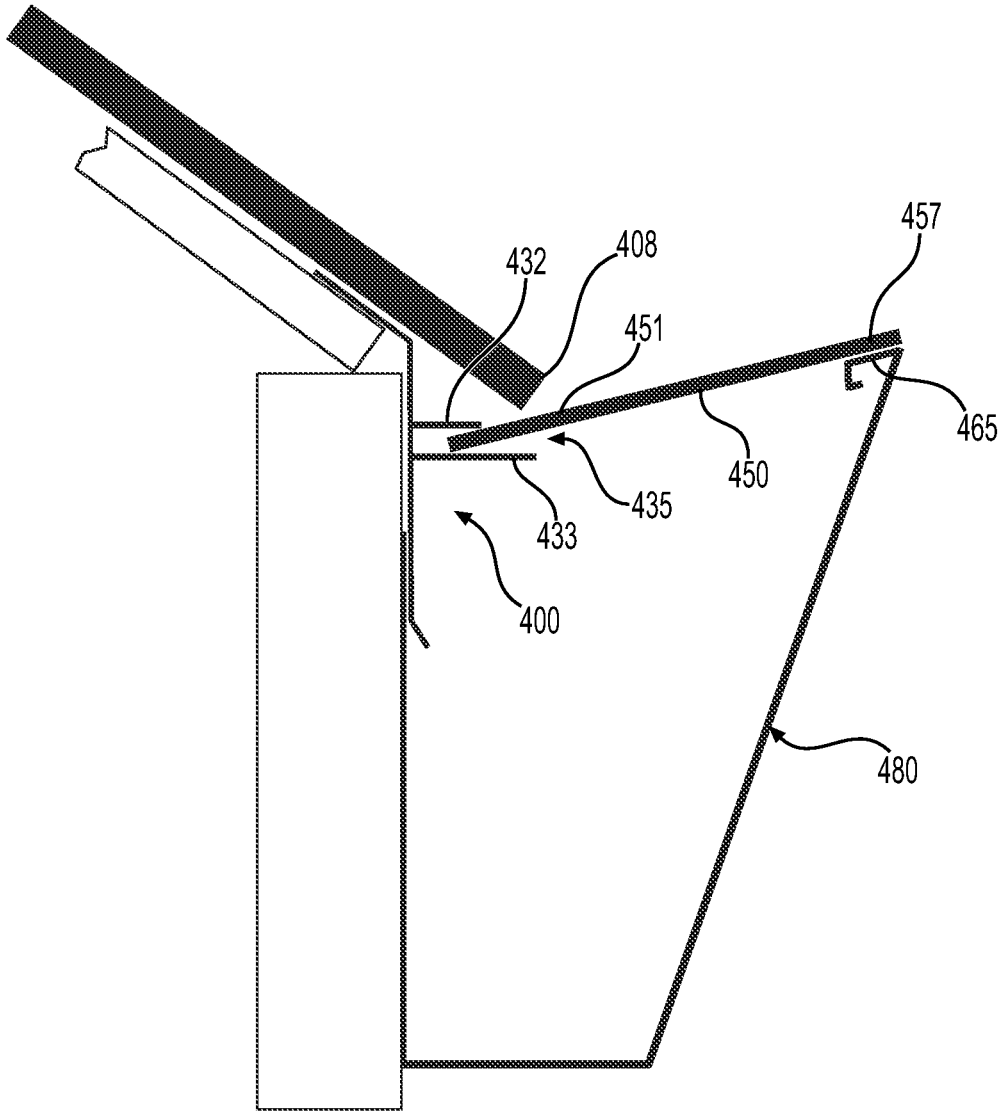
FIG. 6 is a cut-away illustration of an exemplary DEGGS installed to a building.

FIG. 6 is a cut-away illustration of an exemplary DEGGS 400 installed to a building. This exemplary DEGGS 400 has a shorter upper ledge 432 than the lower ledge 433 of receiving channel 435. This design allows for a "reversed angled" installed gutter guard 450 where the back end 451 of the gutter guard 450 is lower than the front end 457 of the gutter guard 450. Because the upper ledge 432 is shorter than the lower ledge 433, the back end 451 of the gutter guard 450 can be inserted and rest more efficiently in the receiving channel 435 and allow for the front end 457 of a gutter guard 450 to be installed higher.

FIG. 6 shows a type of gutter 480 where the gutter's front lip 465 is higher than the roofing edge 408. This type of gutter 480 is sometimes referred to as "tile gutter" and used on Spanish tile and other types of high-flow roofing shingles. This is because the way these tiles are designed, rainwater travels faster and in higher volumes down the roof, often splashing off the roof. The tile gutter's higher front lip 465 helps direct overflow water into the gutter 480 instead of splashing off the roofing edge 408.

Figure 7:
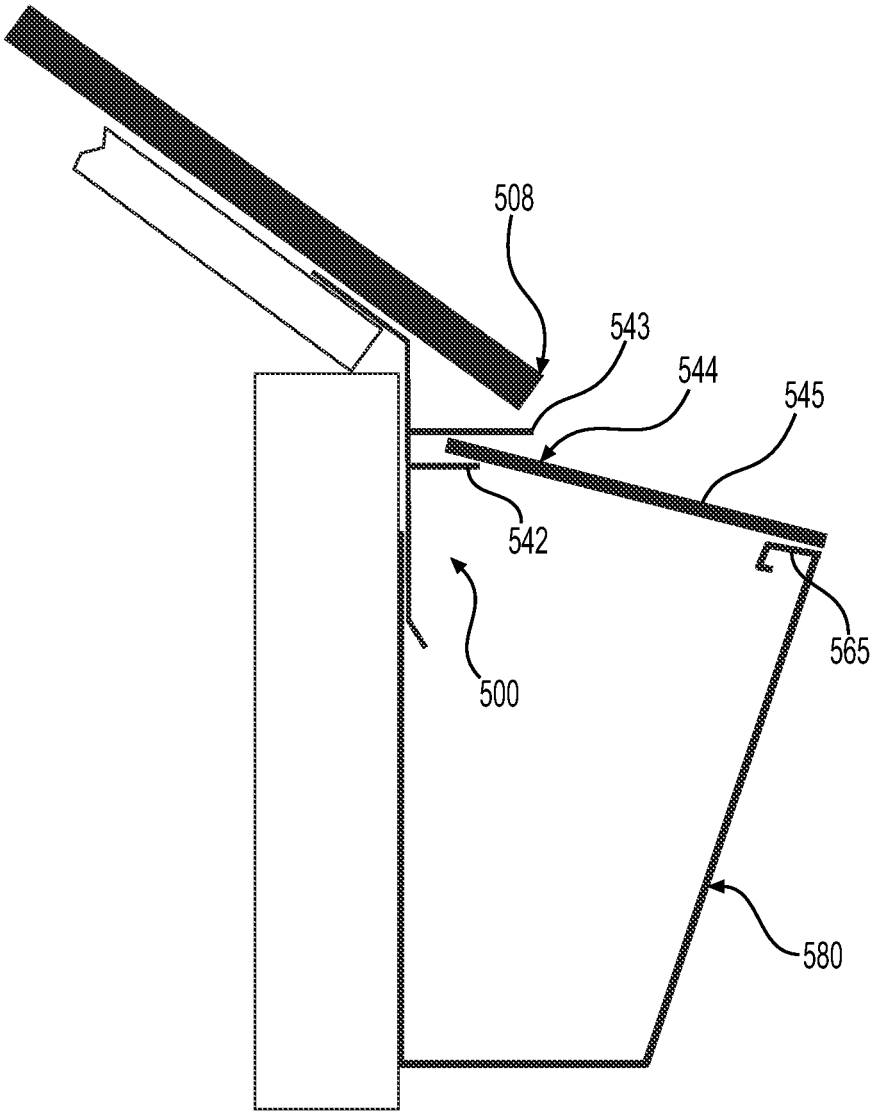
FIG. 7 is a cut-away illustration of another embodiment of an exemplary DEGGS with a shorter bottom ledge than the upper ledge.
Figure 8:
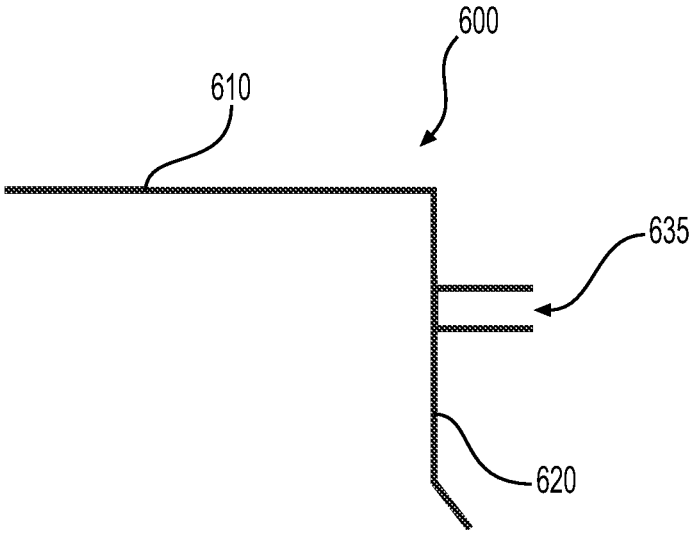
FIG. 8 is a side view illustration of another exemplary DEGGS with a 90 degree angle between the first and second members.

FIG. 7 is a cut-away illustration of another embodiment of an installed DEGGS 500 that has a shorter bottom ledge 542 than the upper ledge 543 of the receiving channel 544. This would allow for a gutter guard 545 to be easily inserted into the receiving channel 544 when situated on a gutter 580 with a front lip 565 that is lower than the roofing edge 508. As can be seen, the installed gutter guard 545 is downwardly sloped. As should be apparent from FIGS. 6 and 7, the difference in the "widths" of the upper and lower ledges result in different accommodating angles and inclinations (up or down) of the gutter guard into the respective receiving channel.

FIG. $ is a side view illustration of another exemplary DEGGS 600 with a 90-degree angle between the first and second members 610, 620. A receiving channel 635 is located along the second member 620 of DEGGS 600, however is substantially lower than a plane of the first member 610. As evident, the receiving channel 635 may be located at different heights on the second member 620. This configuration allows for gutter-to-roof scenarios where roofing shingles may protrude further into the gutter (not shown) or overhang the edge of a roof. The lowered location of the receiving channel 635 provides sufficient separation for easier access and fitment of a gutter guard (not shown) into the receiving channel 635.

Figure 9:
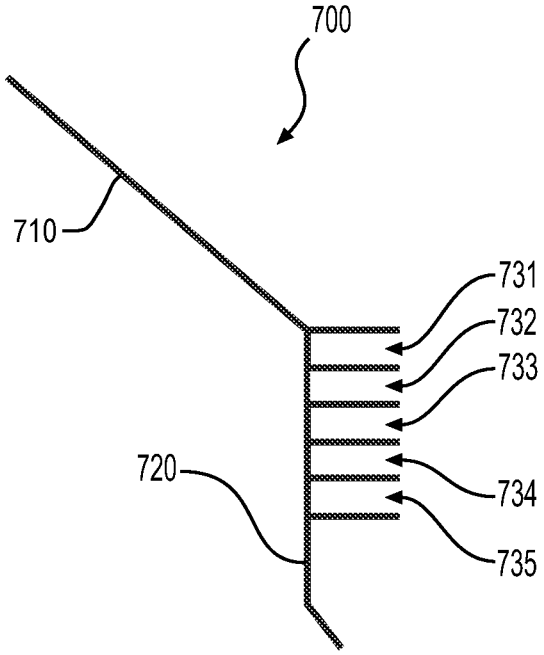
FIG. 9 is a side view illustration of another exemplary DEGGS where the first member is at an obtuse angle with respect to the second member.

FIG. 9 is a side view illustration of another exemplary DEGGS 700 where the first member 710 is at an obtuse angle with respect to the second member 720. Here, second member 720 is shown with multiple, adjacent receiving channels 731-735. This embodiment would provide optional choices for placing the back of a gutter guard (into one of the multiple receiving channels). According y, the gutter guard's installed slope angle could be altered by fitting the gutter guard into a different receiving channel (731-735). While the ledges of the receiving channels are shown as having equal widths, ledges with differing widths may be implemented without departing from the spirit and scope of the exemplary embodiments.

Figure 10:
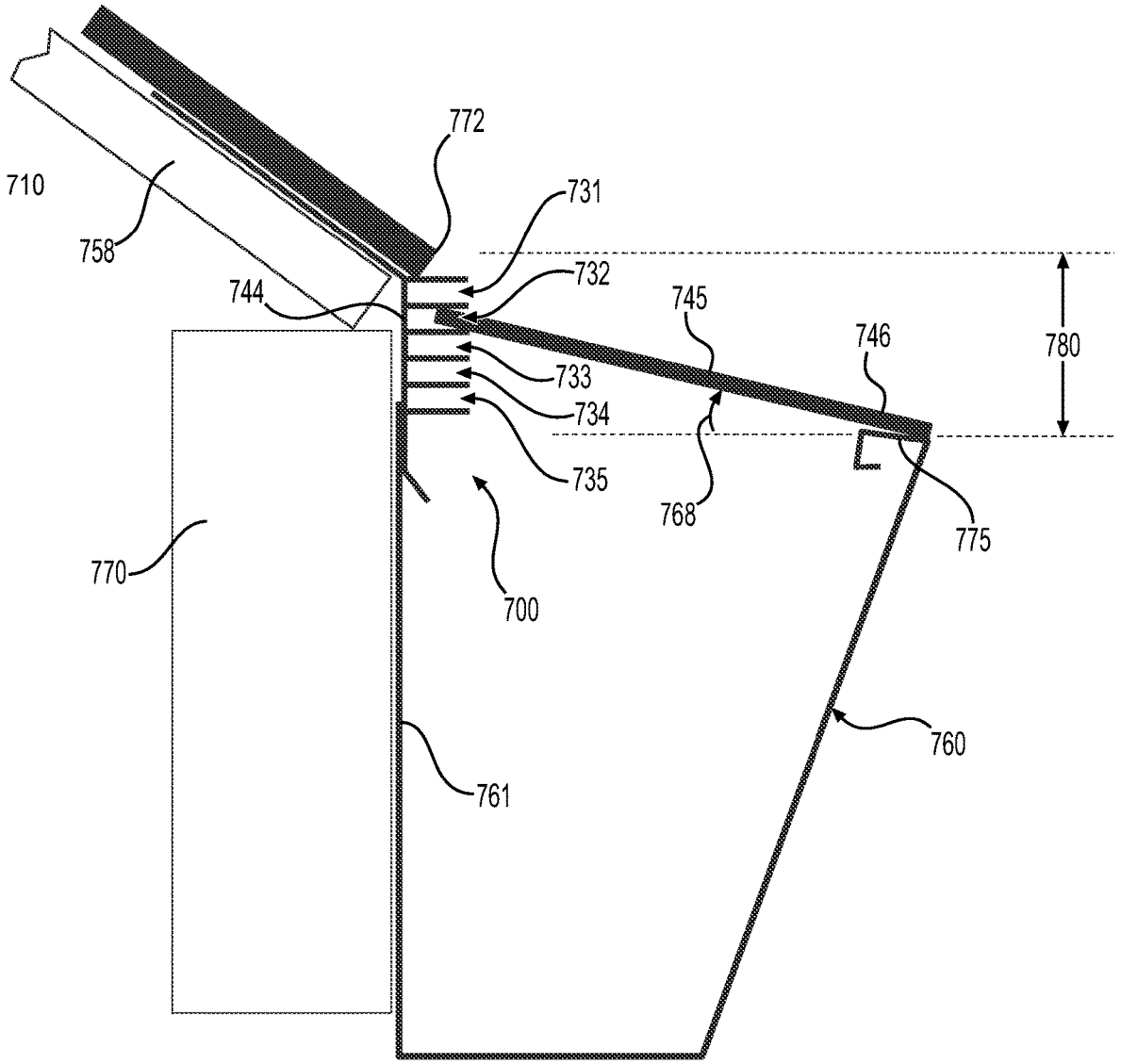
FIG. 10 is cut-away view illustration of an exemplary DEGGS installed with an accompanying gutter and gutter guard.

FIG. 10 is cut-away view illustration of the exemplary DEGGS 700 of FIG. 9 installed with an accompanying goiter 760 and gutter guard 745. The roofing scenario depicted here shows the various angles that a gutter guard 745 can be installed when selecting one of the tiered receiving channels 731-735 as the support for the back 744 of the gutter guard 745, while the front 746 of the gutter guard 745 is attached to the front lip 775 of the gutter 760. As shown, DEGGS 700 has a first member 710 on the roof sheeting, 758. The second member 744 is over the back 761 of the gutter 760. The gutter 760 is connected to the fascia 770. In this example, the gutter guard 745 is installed at approximately 15 degrees 768 when the back 744 of the gutter guard 745 is inserted into receiving channel 732.

It can be appreciated that a ratio of gutter guard angles can be established when considering the distance from the front lip 775 of the gutter 760 to the height 780 of the edge of the roofline 772 and the particular receiving channel being used. The "RATIO OF GUTTER GUARD ANGLES" charts below detail the optional angles available according to the layout in FIG. 10.

RATIO OF GUTTER GUARD ANGLES (with 1 Inch of Roof Height Over Front Lip of Gutter)

| Receiving Channel | Gutter Guard Angle |
|---|---|
| 731 | 8 degrees |
| 732 | 5 degrees |
| 733 | Not applicable (Receiving channel below front lip of gutter) |
| 734 | Not applicable (Receiving channel below front lip of gutter) |
| 735 | Not applicable (Receiving channel below front lip of gutter) |

RATIO OF GUTTER GUARD ANGLES (with 2 Inches of Roof Height Over Front Lip of Gutter)

| Receiving Channel | Gutter Guard Angle |
|---|---|
| 731 | 20 degrees |
| 732 | 15 degrees |
| 733 | 10 degrees |
| 734 | 8 degrees |
| 735 | 0 degrees (Level) |

Figure 11:
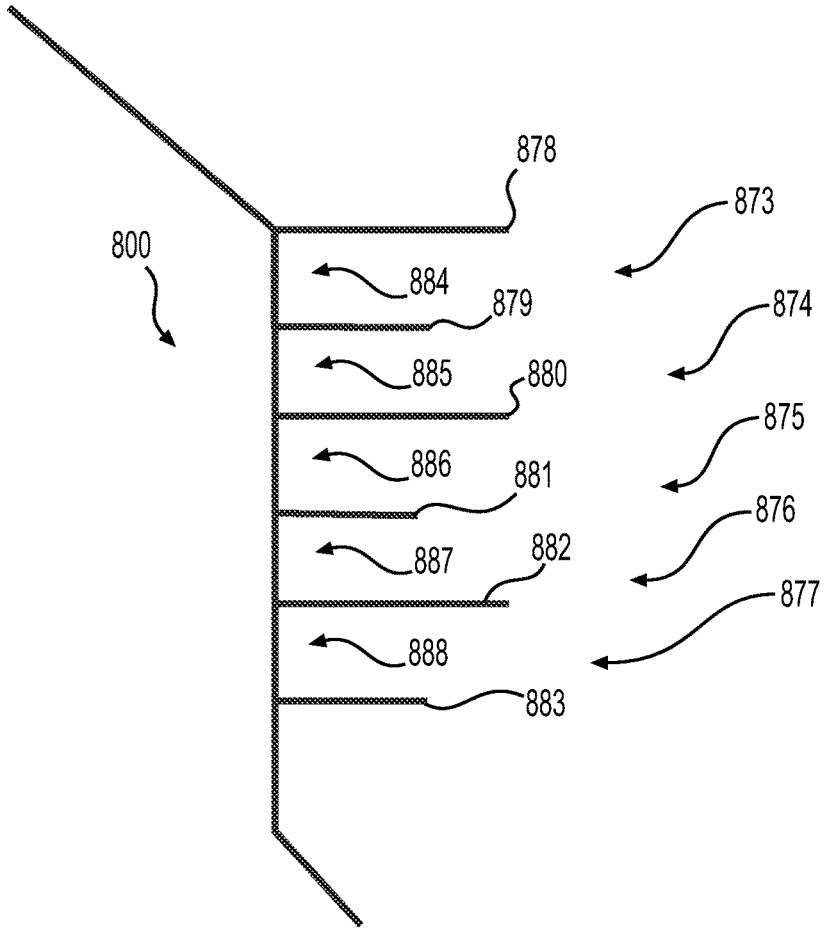
FIG. 11 is a side profile view of an exemplary DEGGS with multiple receiving channels having varying ledge widths.

FIG. 11 is a side profile view of an exemplary DEGGS 800 with multiple receiving channels 873-877 having varying ledge widths. Sequential pairs of the ledges 878-883 form the multiple receiving channels 873-877. Ledges 878-883 can be of varying widths to provide a more flexibility and security in the attachment of the end of a gutter guard (not shown) by allowing the end of the gutter guard to be closer to the rear 884-888 portions of the receiving channels 873-877. This can make the gutter guard (not shown) more secure when placed within a given receiving channel.

As an example, if a gutter guard is installed in receiving channel 873, at an upward angled slope from the front lip of a glitter. (not shown), because ledge 879 is shorter than ledge 878, the end of a gutter guard is less constrained and can be inserted farther within the receiving channel 873 closer to its rear 884. This allows the upper ledge 878 to cover more of the gutter guard, which allows it to be more secure against severe weather storms or heavy debris dropping. The farther the back of a gutter guard can be inserted into the receiving channel the more secure the gutter guard will be connected to the DEGGS.

Figure 12A:
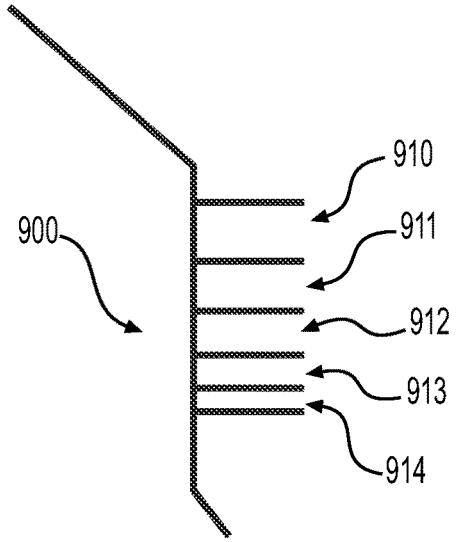
FIG. 12A is a side profile of another exemplary DEGGS with multiple receiving channels, with varied channel separation distances.

FIG. 12A is a side profile of another exemplary DEGGS 900 with multiple receiving channels, however, the separation distances 910-91.4 for the respective channels are varied. This embodiment demonstrates that the receiving channel "widths" may be non-uniform.

Figure 12B:
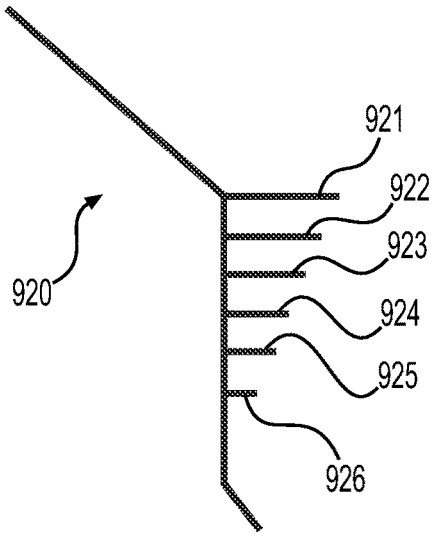
FIG. 12B is a side profile of another exemplary DEGGS with multiple receiving channels, with ledges of unequal lengths.

FIG. 12B is a side profile of another exemplary DEGGS 920 with multiple receiving channels, where the respective ledges 921-926 are all of unequal lengths. The bottom most ledge 926 is the shortest and the upper most ledge 921 is the longest. Because each upper ledge is longer than its nearest lower ledge, such as upper ledge 921 is longer than lower ledge 922, when there is a gutter that is hung lower than the edge of the roofline, each receiving channel can be used to allow the back of a gutter guard to be inserted fluffier into the receiving channel.

It should be appreciated that while the various embodiments described herein show ledges that are approximately 90 degs extended outward from the supporting second member, it is understood that the extension angle may be less than or greater than 90 degs. For example, it may be desirable to have one or more ledges at an acute (or obtuse)

angle so as to provide a greater ledge surface area for the rear of the gutter guard to sit on top of. This would provide more stability to the gutter guard, could reduce debris collecting areas and in some cases allow fasteners to connect the muter guard to the ledges more easily.

Figure 12C:
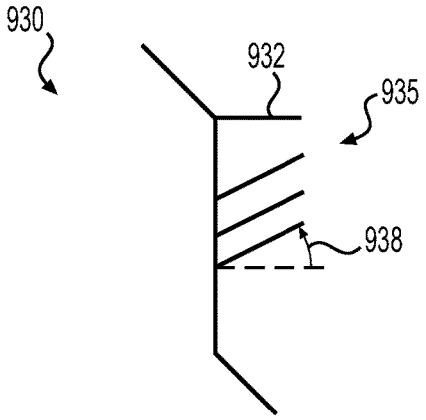
FIG. 12C is a side profile of another exemplary DEGGS with one or more ledges at an inclined angle.

FIG. 12C is a side profile of another exemplary DEGGS 930 with one or more ledges 935 at non-90 deg angles. Upper most ledge 932 can be at 90 deg from a horizontal while one or more subsequent lower ledges 935 can be at an inclined angle 938 off from a horizontal, or declined, as seen in the following FIG.

Figure 12D:
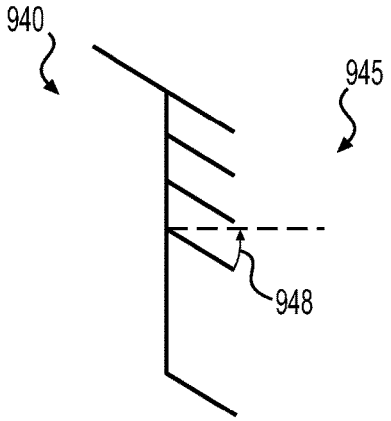
FIG. 12D is a side profile of another exemplary DEGGS with one or more ledges at a declined angle.

FIG. 12D is a side profile of another exemplary DEGGS 940 with one or more ledges 945 at a declined angle 948 off from a perpendicular. The ledge angles and lengths for any one of the inclined/declined embodiments may also be of differing angles and/or lengths, if so desired.

Figure 12E:
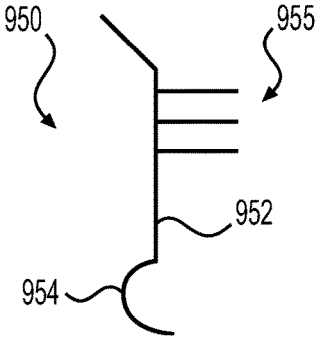
FIG. 12F is a side profile of another exemplary DEGGS with an arced water ramp.
FIG. 12G is a side profile of another exemplary DEGGS with non inform width (or thickness) first and second members.
FIG. 12H is a side profile of another exemplary non-uniform thickness DEGGS.

FIG. 12E is a side profile of another exemplary DEGGS 950 with a set of ledges 955 and an arced water ramp 954. Here, an alternate water ramp 954 is designed to look like an arc whose center is "behind" the plane of the vertical second member 952. The rearward protrusion of the arc can help to secure a gutter's back end when placed between the DEGGS 950 and a fascia (not shown), while the forward portion of the arc still functions to ramp water away from the fascia.

Figure 12F:
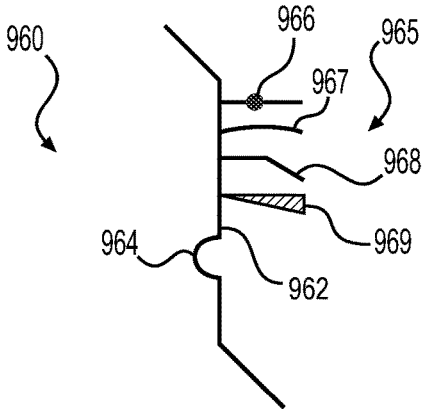

FIG. 12F is a side profile of another exemplary DEGGS 960 with a set of ledges 965 and an arc 964 extending from the second member 962. This embodiment is a variation of the embodiment of FIG. 12E, wherein the arc is higher and within the second member 962. This embodiment also shows various other ledge profiles and shapes. For example, a "bump" or raised area 966 is shown on the topmost ledge. A curved ledge 967, bend ledge 968 and non-uniform thickness ledge 969 are shown in the remaining ledges. Therefore, ledges may be of different shapes, sizes, orientations, lengths, etc., if so desired.

Figure 12G:
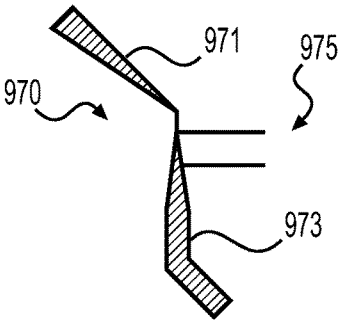

FIG. 12G is aside profile of another exemplary DEGGS 970 with a set of ledges 975 but with non-uniform width (or thickness) first member 971 and second member 973. This embodiment illustrates that the material composing the respective members (and/or water ramp) may not need to be uniform in thickness.

Figure 12H:
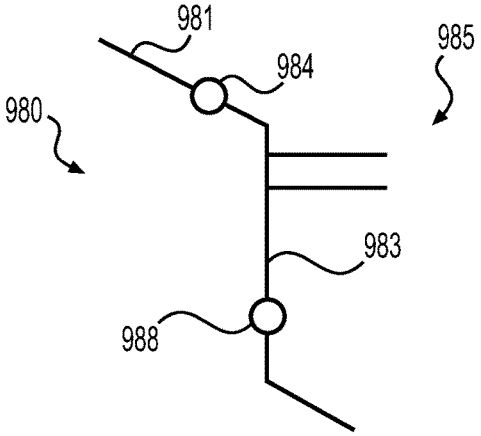

FIG. 12H is a side profile of another exemplary non-uniform DEGGS 980 with a set of ledges 985 and one or more non-uniform sections 984, 988 in the first member 981 and second member 983, respectively. While the non-uniform sections 984, 988 are shown here as circles, they may be of any desired shape, size and location on the members. For example, in one embodiment only the bottom non-uniform section 988 may be desired and it may be of sufficient size to provide the pinching action described in FIGS. 12E-F's arcs.

Figure 13:
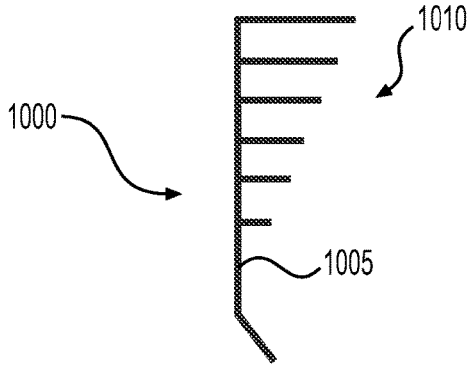
FIG. 13 is a side profile of another exemplary multi-receiving channel DEGGS without a first member.

FIG. 13 is a side profile of another exemplary decreasing/increasing width multi-receiving channel. DEGGS 1000 without a first member. This embodiment contemplates the possibility that any of the previously DEGGSs may also be fabricated without a first member (over the roof edge), where it may be difficult or impossible to attach a first member-containing DEGGS to the roof, or the DEGGS is desired to be attached at a lower fascia location than normally done.

Figure 14:
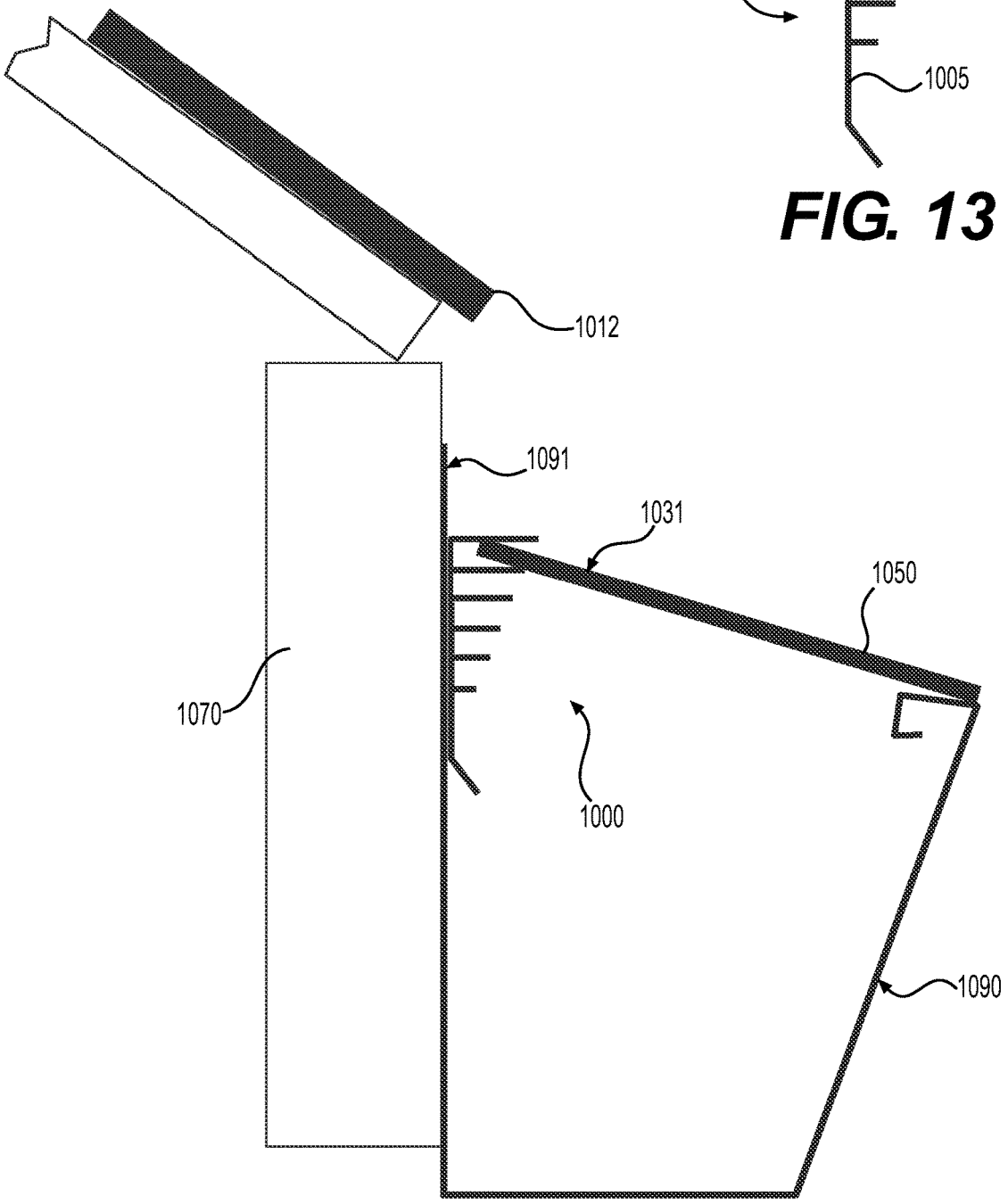
FIG. 14 is an illustration of an exemplary DEGGS installed to a building with accompanying gutter and gutter guard.

FIG. 14 is an illustration of the DEGGS 1000 of FIG. 13 installed to a building with accompanying gutter 1090 and gutter guard 1050. DEGGS 1000 is an embodiment that can be used in situations where the gutter 1090 is hung lower than the edge of the roofline 1012. Not having a first member allows the DEGGS 1000 to be installed lower on the back of the gutter 1090 or fascia 1070. For example, an inspection of FIG. 14 reveals DEGGS 1000 is installed below the topmost back portion 1091 of the gutter 1090. Moreover, with the gutter guard 1050 in the DEGGS's topmost receiving channel 1031, it can have a lower angle of inclination than if the DEGGS 1000 was installed at or nearly at the location of the topmost back portion 1091 of the gutter 1090.

A DEGGS with multiple receiving channels, whether it has a first member or not, provides multiple gutter guard installation advantages. For example, the gutter guard contractor has options of which angle the gutter guard can be installed at. If the building structure has many trees near the roof and gutters. Whereby large amounts of leaves, pine needles or other tree debris are a concern, the back of the gutter guard can be installed at the highest receiving channel to optimize the greatest inclination angle for the gutter guard to help shed debris more easily off. Conversely, if there is less concern for roof-top debris (e.g., low growing shrubs or trees), the gutter guard contractor could install the back of the gutter guard in the lowest receiving channel.

Figure 15:
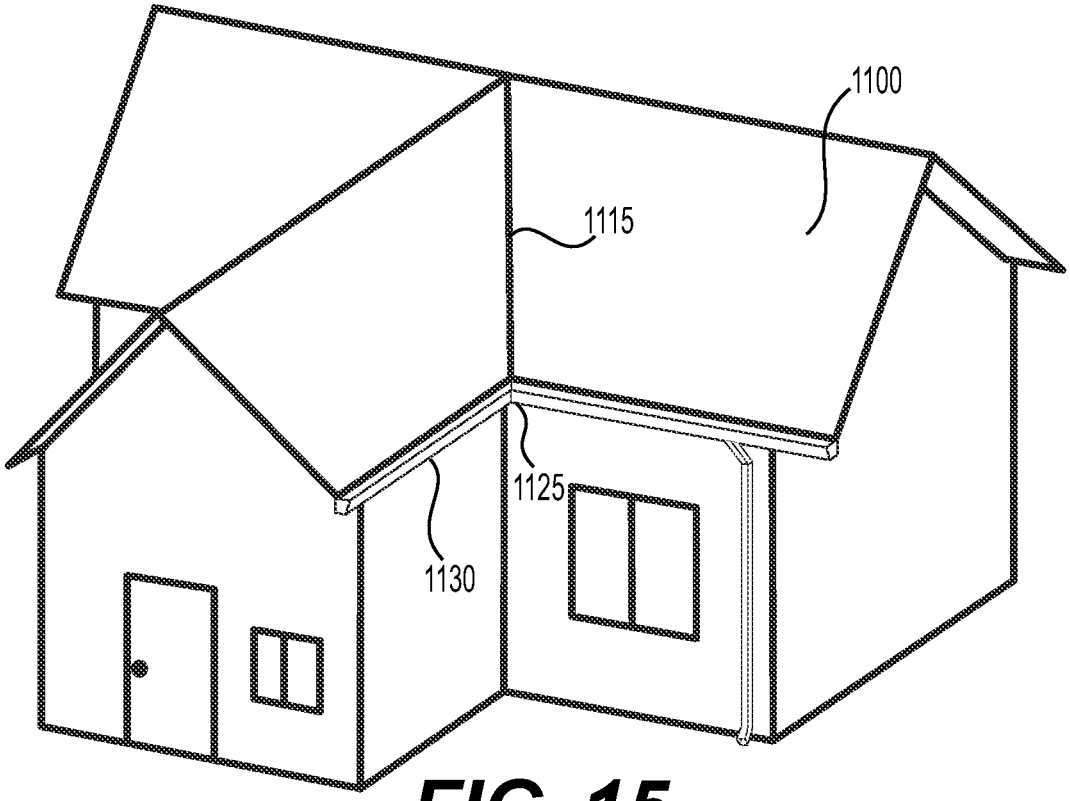
FIG. 15 is an illustration of a home with one or more steep valleys in the roof.

Additionally, with a DEGGS having multiple receiving channels, for areas or sections on the gutter that experience heavier water flow, the back of the gutter guard could be installed on a lower receiving channel so the gutter guard is less inclined. When the gutter guard is less inclined, water that would tend to flow over the gutter guard will fall into the gutter. For example, FIG. 15 is an illustration of a home with one or more steep valleys 1115 in the roof 1100, where higher water flow 1125 off the roof. 1100 into the gutter or gutter guard 1130 is expected. For these high flow areas, to reduce or eliminate common gutter guard runoff, the gutter guard 1130 can be installed at a reduced inclination (e.g., at a lower receiving channel).

Figure 16:
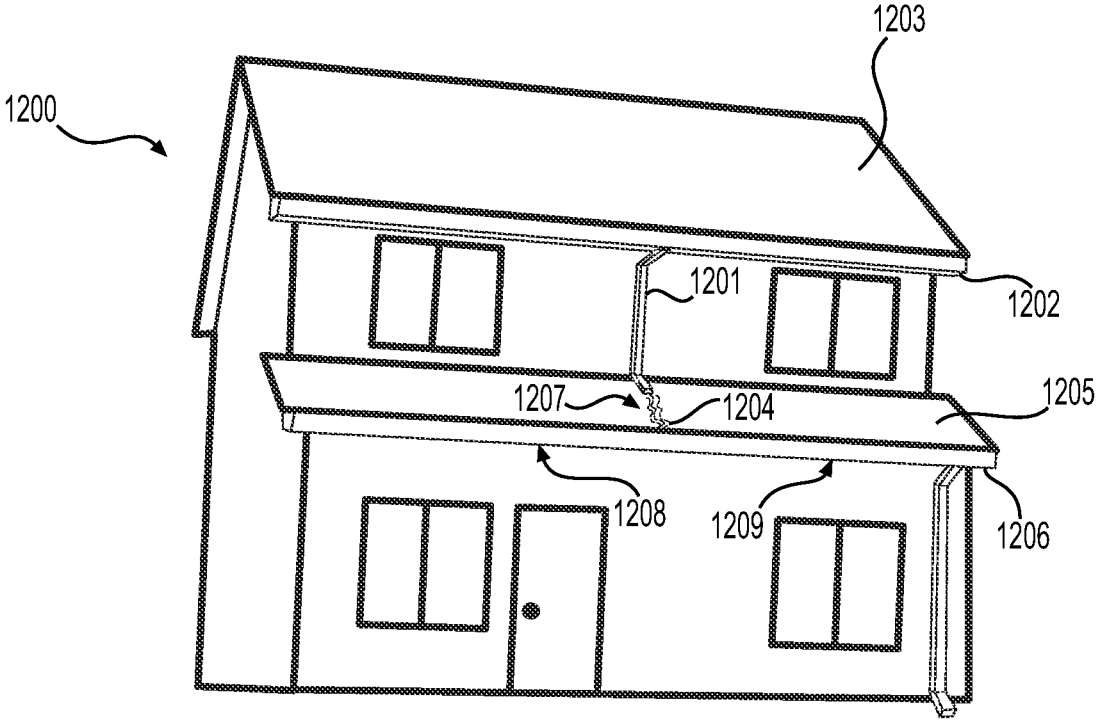
FIG. 16 is an illustration of a gutter-tiered house with an upper roof and lower roof.

A similar problem can occur for downspouts in a multi-elevation glittered building. FIG. 16 is an illustration of a gutter-tiered house 1200 with an upper roof 1203 with accompanying upper gutter 1202 connected to a downspout 1201 draining onto lower roof 1205. Here, the water from upper gutter 1202 falls onto section 1207 of lower roof 1205 and then onto lower gutter 1206. Section 1217 represents a high water flow area. For the gutter section immediately below section 1217, the gutter guard could be installed at a lower receiving channel to address the high water flow. While for other gutter sections that are non-high flow areas 1208, 1209, the gutter guard could be installed at a higher receiving channel. The exemplary embodiments give a gutter guard contractor flexibility to alter the angle of the gutter guard at various locations throughout the entire gutter system on a building structure.

There may be times the gutter contractor installed the gutter guard at too shallow an angle to appropriately shed debris. A steeper angle would help to more easily remove debris from the gutter guard. The only way to obtain a steeper angle on a conventionally installed gutter guard system, is to uninstall the entire gutter system and downspouts. Then the gutter is reinstalled at a lower position and the gutter guard reinstalled. This conventional process is very labor intensive and therefore expensive. Using the exemplary DEGGS embodiments, the above can be easily achieved by repositioning the gutter guard into a higher receiving channel without needing to lower the gutters or downspouts.

Another benefit of the exemplary DEGGSs, is when trees in the area may have grown taller or denser causing an increased amount of debris. Therefore, while a prior gutter guard inclination angle may have been suitable for the limited debris at the time of installation, it may no longer be suitable for the later increased debris. Simply by reinstalling the gutter guard into a higher receiving channel will provide a means for addressing the increased debris.

Figure 17:
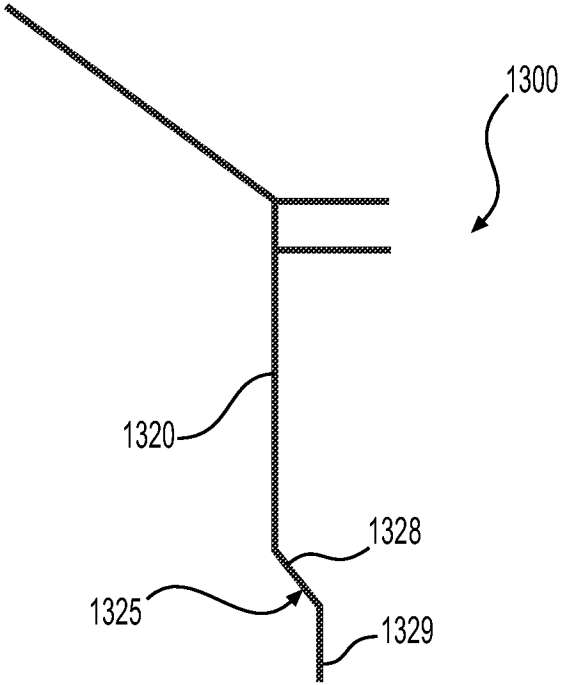
FIG. 17 is a side profile of another exemplary DEGGS with a water ramp having multiple portions.

FIG. 17 is a side profile of another exemplary DEGGS 1300 with a water ramp 1325 having multiple portions. Water ramp 1325 is shown having a first portion 1328 angled (or curved) away from the plane of the second member 1320 and a second portion 1329 extending from the first portion 1328, but angled (or curved) substantially in-line or parallel to the second member 1320. The "downward" orientation of the second portion 1329 acts to "guide" or assist the travel of water from the water ramp 1325 into a more central location of the gutter (not shown), rather than potentially dripping down the back of the fascia or gutter.

Figure 18:
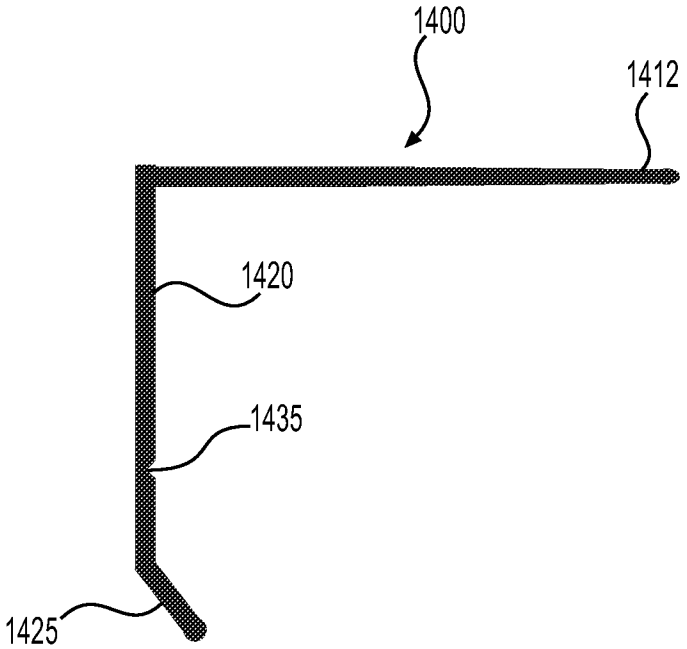
FIG. 18 is a side profile of another exemplary DEGGS only having a single ledge, a second member, and a water ramp.

In some embodiments, a DEGGS can also have just one ledge and not have a receiving channel or a first member. For example, FIG. 18 is a side profile of another exemplary DEGGS 1400 only having a single ledge 1412, a second member 1420, and a water ramp 1425. It is evident that the general shape is that of the letter L, albeit turned to its side. The single ledge 1412 can also be referred to as a top plate 1412. This embodiment is generally used if a gutter contractor wishes to just screw or attach the back end of a gutter guard (not shown) to the DEGGS 1400 instead of inserting it into a receiving channel. In these instances, having just a top plate 1412 will suffice for the gutter contractor.

The second member of any DEGGS configuration can also have one or more relief troughs 1435 (or alternatively called screw trough) disposed longitudinally in the second member 1420. The purpose of the relief trough(s) 1435 is to provide a means for reducing screw wobble or skip when screwing into the second member 1420 when securing the DEGGS to a fascia. Specifically, gutter contractors can place the tip of a screw into the relief trough 1435 which will "anchor" the screw allowing it to better penetrate the DEGGS when fastening it to the fascia. As stated above, multiple relief troughs can be disposed about the second member.

Figure 19:
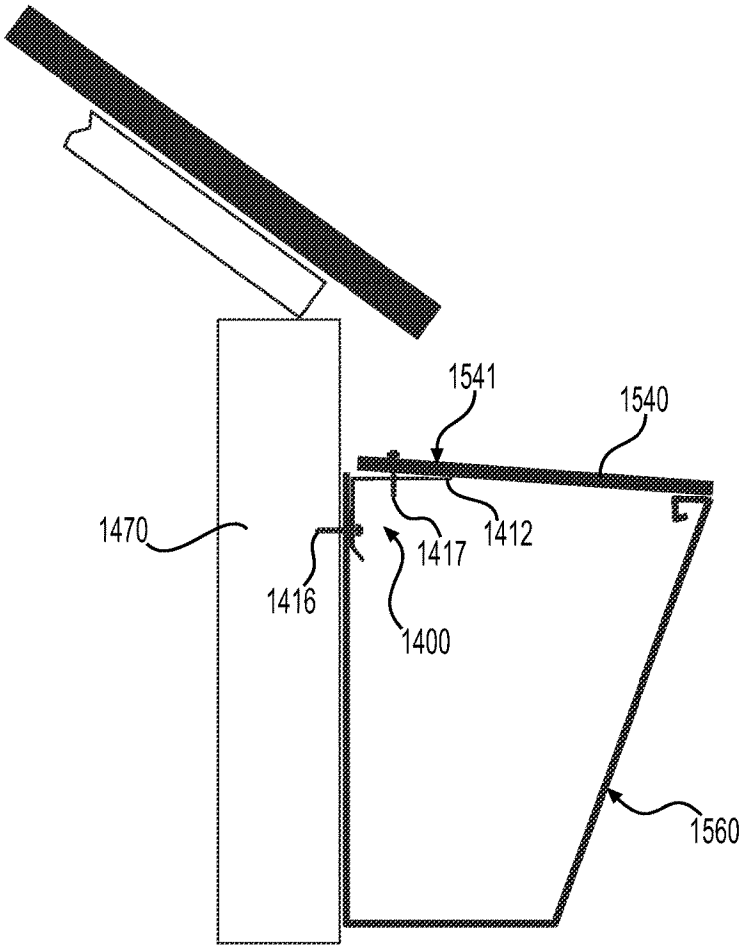
FIG. 19 is a cut-away illustration of an exemplary DEGGS attached to a gutter and installed gutter guard.

FIG. 19 is a cut-away illustration of the DEGGS embodiment 1400 of FIG. 18 attached to a gutter 1560 with an installed gutter guard 1540. The DEGGS 1400 is shown screwed 1416 through the back of the gutter into fascia 1470. Back end 1541 of gutter guard 1540 is screwed 1417 into the top plate 1412 of the DEGGS 1400. It is understood that in some embodiments, end 1541 of gutter guard 1540 may be secured to the top plate 1412 through alternative means, such as stapling, glue, adhesives, and so forth.

Figure 20:
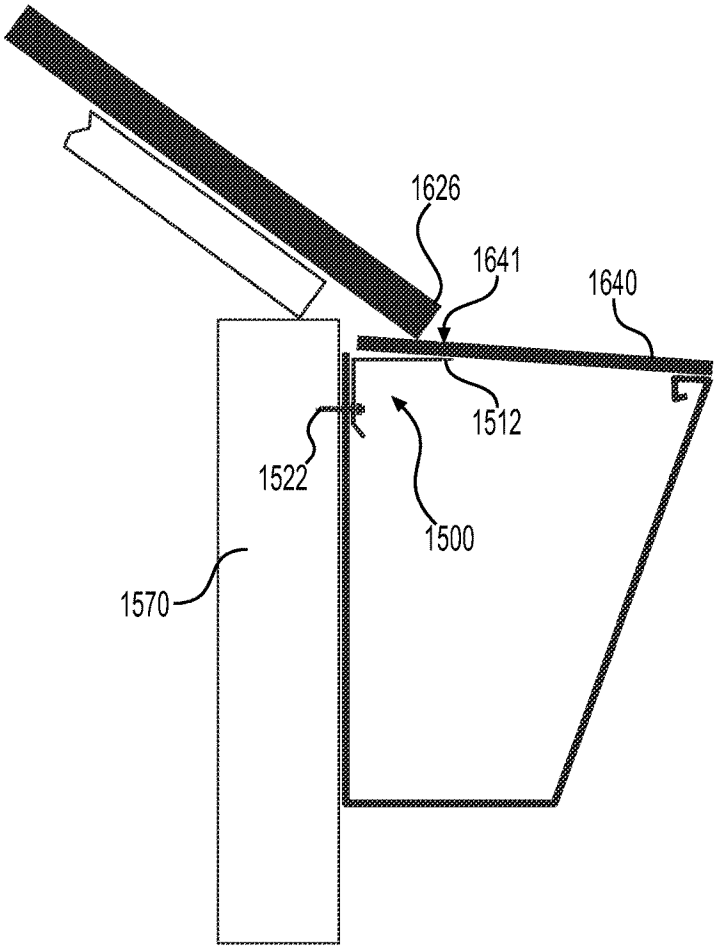
FIG. 20 illustrates and exemplary DEGGS wherein the end of the gutter guard pressed against the DEGGS top plate by a roofing shingle.

In some situations a screw or adhesion means is not necessary to fasten the end of a gutter guard to the top plate of a DEGGS. For example, as shown in FIG. 20. While a screw 1522 is used to fasten the DEGGS 1500 to the fascia 1570, the end 1641 of gutter guard 1640 is pressed against (or prevented from lifting off) top plate 1512 by roofing shingle 1626.

The present disclosure is not to be limited m terms of the particular embodiments described in this application, which are intended as illustrations of various aspects. Many modifications and variations can be made without departing from its scope, as will be apparent to those skilled in the art. Functionally equivalent methods and apparatuses within the scope of the disclosure, in addition to those enumerated herein, will be apparent to those skilled in the art from the foregoing descriptions. Such modifications and variations are intended to fall within the scope of the appended claims. The present disclosure is to be limited only by the terms of the appended claims, along with the full scope of equivalents to which such claims are entitled. It is to be understood that this disclosure is not limited to particular methods, implementations, and realizations, which can, of course, vary it is also to be understood that the terminology used herein is for the purpose of describing particular embodiments only and is not intended to be limiting.

While various aspects and embodiments have been disclosed herein, other aspects and embodiments will be apparent to those skilled in the art. The various aspects and embodiments disclosed herein are for purposes of illustration and are not intended to be limiting, with the true scope being indicated by the following claims.

What is claimed is:

1. A drip edge with gutter guard support device, comprising:

a longitudinal sheet of waterproof material, having a side profile with a first member substantially horizontal in orientation, having a fascia side end and a closed non-fascia end, an overall thickness of the first member decreasing from the fascia side end to the non-fascia side end; and a second member, integrally joined in a substantially vertical orientation to the fascia side end of the first member to form an angled L-shaped structure, wherein the first member is longer than the second member and the second member being configured to be placed over a back end of a prospective gutter wherein the device is a single piece drip edge and gutter guard fascia-side attachment device.

2. The device of claim 1, further comprising at least one score line horizontally oriented on an interior of the second member.

3. The device of claim 1, further comprising a water ramp, the water ramp being disposed on a bottom terminal end of the second member.

4. The device of claim 3, wherein the water ramp is multiply-angled.

5. The device of claim 3, wherein the water ramp contains an arc, the arc acting to press against a top end of a prospective gutter under the water ramp.

6. The device of claim 3, wherein the score line is above the water ramp.

7. The device of claim 2, further comprising a fastener inserted into a vertical position defined by the at least one score line.

8. The device of claim 1, wherein an angle between the first member and second member is approximately 90 degrees.

9. The device of claim 1, wherein the device is constructed from at least one of a sheeted, extruded, and coiled material.

10. The device of claim 9, wherein the material is at least one of aluminum, steel, metal and plastic.

11. A drip edge with gutter guard support device, comprising:

a vertical member configured to be placed inside and over a back end of a prospective gutter; and a horizontal gutter guard support member integral to and extending outwardly from a top of the vertical member into an opening of the prospective gutter, wherein the horizontal gutter guard support member is longer than the vertical member, and a terminal end of the horizontal gutter guard support member is closed and thinner than an end integral to the vertical member, wherein the device has an inverted L-shape being longitudinal in form and of a waterproof material.

12. The device of claim 11, wherein the vertical member and horizontal gutter guard support member are planar members joined at a shared end.

13. The device of claim 11, further comprising at least one score line horizontally oriented on an interior of the vertical member.

14. The device of claim 11, further comprising a water ramp, the water ramp being disposed on a bottom terminal end of the vertical member.

15. The device of claim 14, wherein the water ramp is multiply-angled.

16. The device of claim 14, wherein the water ramp contains an arc, the arc acting to press against a top end of a prospective gutter under the water ramp.

17. The device of claim 13, wherein at least one score line is above a water ramp disposed on a bottom terminal end of the vertical member.

18. The device of claim 13, further comprising a fastener inserted into a vertical position defined by the at least one score line.

19. The device of claim 11, wherein the device is constructed from at least one of a sheeted, extruded, and coiled material.

20. The device of claim 19, wherein the material is at least one of aluminum, steel, metal and plastic.

21. The device of claim 11, wherein an angle between the first member and second member is approximately 90 degrees.

22. A gutter guard support and drip edge device, comprising:

an inverted-shaped unitary sheet of waterproof material, a side profile of the device having a top horizontal planar arm integrally joined to an upper end of a vertical planar arm, wherein the vertical planar arm is shorter in length than the top horizontal planar arm, and a thickness of an internal end of the upper arm is greater than a thickness of a terminal end of the upper arm, wherein when the device is installed into a gutter the top horizontal planar arm rests under a gutter guard while the vertical planar arm is attached inside a gutter wall to act as a drip edge.

23. The device of claim 22, wherein the inverted L-shape is approximately 90 degrees.

* * * * *